US012398948B2

(12) United States Patent
Park et al.

(10) Patent No.: US 12,398,948 B2
(45) Date of Patent: Aug. 26, 2025

(54) REFRIGERATOR

(71) Applicant: SAMSUNG ELECTRONICS CO., LTD., Suwon-si (KR)

(72) Inventors: Hosang Park, Suwon-si (KR); Jeonghyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 148 days.

(21) Appl. No.: 18/124,737

(22) Filed: Mar. 22, 2023

(65) Prior Publication Data

US 2023/0221062 A1 Jul. 13, 2023

Related U.S. Application Data

(63) Continuation of application No. PCT/KR2021/014422, filed on Oct. 15, 2021.

(30) Foreign Application Priority Data

Nov. 18, 2020 (KR) ..... 10-2020-0154981
Jun. 24, 2021 (KR) ..... 10-2021-0082452

(51) Int. Cl.
*F25D 23/00* (2006.01)
*F25D 23/06* (2006.01)

(52) U.S. Cl.
CPC ..... *F25D 23/063* (2013.01)

(58) Field of Classification Search
CPC ..... F25D 23/063; F25D 2400/18; A47B 2096/208; A47B 96/20
USPC ..... 312/406.2, 204, 406, 265.5, 265.6; 62/259.1
See application file for complete search history.

(56) References Cited

U.S. PATENT DOCUMENTS 3,520,581 A * 7/1970 Borghi ..... F25D 23/064 312/236
4,701,066 A * 10/1987 Beam ..... A47B 96/201 403/298
5,496,104 A * 3/1996 Arnold ..... E05D 5/065 312/204
8,651,590 B2 2/2014 Wilson et al.
(Continued)

FOREIGN PATENT DOCUMENTS

CN 207299701 U 5/2018
DE 2003 727 9/1970
(Continued)

OTHER PUBLICATIONS

English translation of KR100781602 (Year: 2007).*
(Continued)

*Primary Examiner* — Janet M Wilkens
(74) *Attorney, Agent, or Firm* — STAAS & HALSEY LLP

(57) ABSTRACT

A refrigerator including a cabinet having an outer case; a side panel including a main body; and an upper panel, wherein the side panel is configured to be detachably mounted on an outside of the outer case so that the main body forms an exterior of one side surface of the cabinet while the side panel is mounted to the outside of the outer case, and the upper panel is configured to be detachably coupled to the side panel while the side panel is mounted to the outside of the outer case so that the upper panel covers an upper portion of the cabinet.

12 Claims, 20 Drawing Sheets

(56) References Cited

U.S. PATENT DOCUMENTS

| | | | | |
|---|---|---|---|---|
| 8,789,900 | B2 * | 7/2014 | Laible | A47B 96/20 312/204 |
| 9,719,718 | B2 | 8/2017 | Piendl et al. | |
| 10,480,240 | B2 | 11/2019 | Toll et al. | |
| 2004/0222725 | A1 | 11/2004 | Park et al. | |
| 2008/0011006 | A1 * | 1/2008 | Luisi | F25D 23/10 312/406 |
| 2013/0221814 | A1 * | 8/2013 | Ahlgrim | A47B 43/02 29/525.08 |
| 2014/0110414 | A1 | 4/2014 | Piendl et al. | |

FOREIGN PATENT DOCUMENTS

| | | | | |
|---|---|---|---|---|
| DE | 10 2005 002 147 | A1 | 7/2006 | |
| EP | 1 504 711 | A2 | 2/2005 | |
| EP | 2484996 | A1 * | 8/2012 | F25D 23/063 |
| JP | 2000-146422 | A | 5/2000 | |
| JP | 2003-130542 | A | 5/2003 | |
| JP | 3939958 | B2 | 4/2007 | |
| JP | 4216456 | B2 | 11/2008 | |
| JP | 2014-506987 | A | 3/2014 | |
| JP | 5657301 | B2 | 12/2014 | |
| KR | 10-2004-0096688 | A | 11/2004 | |
| KR | 10-0751015 | B1 | 8/2007 | |
| KR | 100781602 | B1 * | 12/2007 | |
| KR | 10-1351086 | B1 | 1/2014 | |
| KR | 10-2014-0075282 | A | 6/2014 | |
| WO | WO-2016067249 | A2 * | 5/2016 | A47B 47/00 |

OTHER PUBLICATIONS

International Search Report, PCT/ISA/210, dated Feb. 10, 2022, in International Application No. PCT/KR2021/014422.

Extended European Search Report dated Jan. 4, 2024 for European Application No. 21894895.8.

Chinese Office Action dated Jun.28, 2025 for Chinese Application No. 202180068184.3.

Europan Office Action dated Jul. 3, 2025 for European Application No. 21894895.8.

* cited by examiner

REFRIGERATOR

CROSS-REFERENCE TO RELATED APPLICATIONS

This application is a continuation application under 35 U.S.C. § 111(a) of international Application No. PCT/KR2021/014422, filed on Oct. 15, 2021, which claims priority to Korean Patent Application No. 10-2020-0154981, filed on Nov. 18, 2020, and Korean Patent Application No. 10-2021-0082452, filed on Jun. 24, 2021, the disclosures of which are incorporated by reference herein in their entireties.

BACKGROUND

1. Field

The present disclosure relates to a refrigerator including an improved structure.

2. Description of the Related Art

A refrigerator is a device that keeps food fresh by including a main body including a storage compartment, and a cold air supply system configured to supply cold air to the storage compartment.

The storage compartment includes a refrigerating compartment maintained at approximately 0 to 5° C. to store food in a refrigerated manner, and a freezing compartment maintained at approximately 0 to −30° C. to store food in a frozen manner. In general, the storage compartment includes an open front surface, and the open front surface is opened and closed by a door.

The refrigerator may be classified according to the shape of the storage compartment and the door. The refrigerator may be classified into a Top Mounted Freezer (TMF) type refrigerator in which a storage compartment is partitioned vertically by horizontal partition walls to form a freezing compartment on an upper side and a refrigerating compartment on a lower side, and a Bottom Mounted Freezer (BMF) type refrigerator in which a refrigerating compartment is formed on an upper side and a freezing compartment is formed on a lower side.

Further, the refrigerator may be classified into a Side by Side (SBS) type refrigerator in which a storage compartment is divided into left and right sides by vertical partition walls to form a freezing compartment on one side and a refrigerating compartment on the other side, and a French Door Refrigerator (FDR) type refrigerator in which a storage compartment is partitioned vertically by horizontal partition walls to form a refrigerating compartment on an upper side and a freezing compartment on a lower side, and the refrigerating compartment on the upper side is open and closed by a pair of doors.

SUMMARY

Aspects of embodiments of the disclosure will be set forth in part in the description which follows and, in part, will be apparent from the description, or may be learned by practice of the presented embodiments.

According to an embodiment of the disclosure, a refrigerator may include a cabinet including an outer case; a side panel including a main body; and an upper panel. The side panel may be configured to be detachably mounted on an outside of the outer case so that the main body forms an exterior of one side surface of the cabinet while the side panel is mounted to the outside of the outer case, and the upper panel may be configured to be detachably coupled to the side panel while the side panel is mounted to the outside of the outer case so that the upper panel covers an upper portion of the cabinet.

According to an embodiment of the disclosure, the refrigerator further includes a panel fixing trim coupled to a bottom surface of the cabinet and including a support flange extending toward the side panel so as to be inserted into a bottom end of the side panel to support the side panel while the side panel is mounted to the outside of the outer case.

According to an embodiment of the disclosure, the side panel includes a trim coupling body bent at a lower end of the main body and configured to be coupled to the panel fixing trim.

According to an embodiment of the disclosure, the trim coupling body includes a trim receiving member including a receiving space configured to receive the support flange of the panel fixing trim.

According to an embodiment of the disclosure, the panel fixing trim includes a guide protrusion protruding outward from the support flange and configured to be inserted into the trim receiving member.

According to an embodiment of the disclosure, the side panel includes a cabinet coupling body bent at an upper end of the main body so as to be coupled to the cabinet.

According to an embodiment of the disclosure, the refrigerator further includes a panel fixing bracket mounted on an upper surface of the cabinet and configured to be coupled to the cabinet coupling body.

According to an embodiment of the disclosure, the cabinet coupling body includes a first flange configured to be seated on the upper surface of the cabinet, a bracket coupler on the first flange and configured to be coupled to the panel fixing bracket, and a second flange bent from the main body and connected to the first flange, the second flange forming a seating space in which one side portion of the upper panel may be seated.

According to an embodiment of the disclosure, the second flange includes a fixing hole, the upper panel includes a fixing protrusion extending inwardly from the one side portion of the upper panel, and the fixing protrusion is configured to be inserted into the fixing hole while the one side portion of the upper panel is seated in the seating space.

According to an embodiment of the disclosure, the side panel is configured to be fixed to the cabinet by hooking a lower end of the side panel to the support flange and coupling an upper end of the side panel to the upper portion of the cabinet.

According to an embodiment of the disclosure, the refrigerator further includes a magnet disposed between the outer case and the side panel while the side panel is mounted to the outside of the outer case to prevent a movement of the side panel.

According to an embodiment of the disclosure, the side panel includes a first side panel to cover a first side surface of the outer case while the first side panel is mounted to the outside of the outer case, and a second side panel to cover a second side surface of the outer case while the second side panel is mounted to the outside of the outer case, and the upper panel is inserted into and fixed to an upper end of the first side panel and an upper end of the second side panel while the first side panel and the second side panel are mounted to the outside of the outer case.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
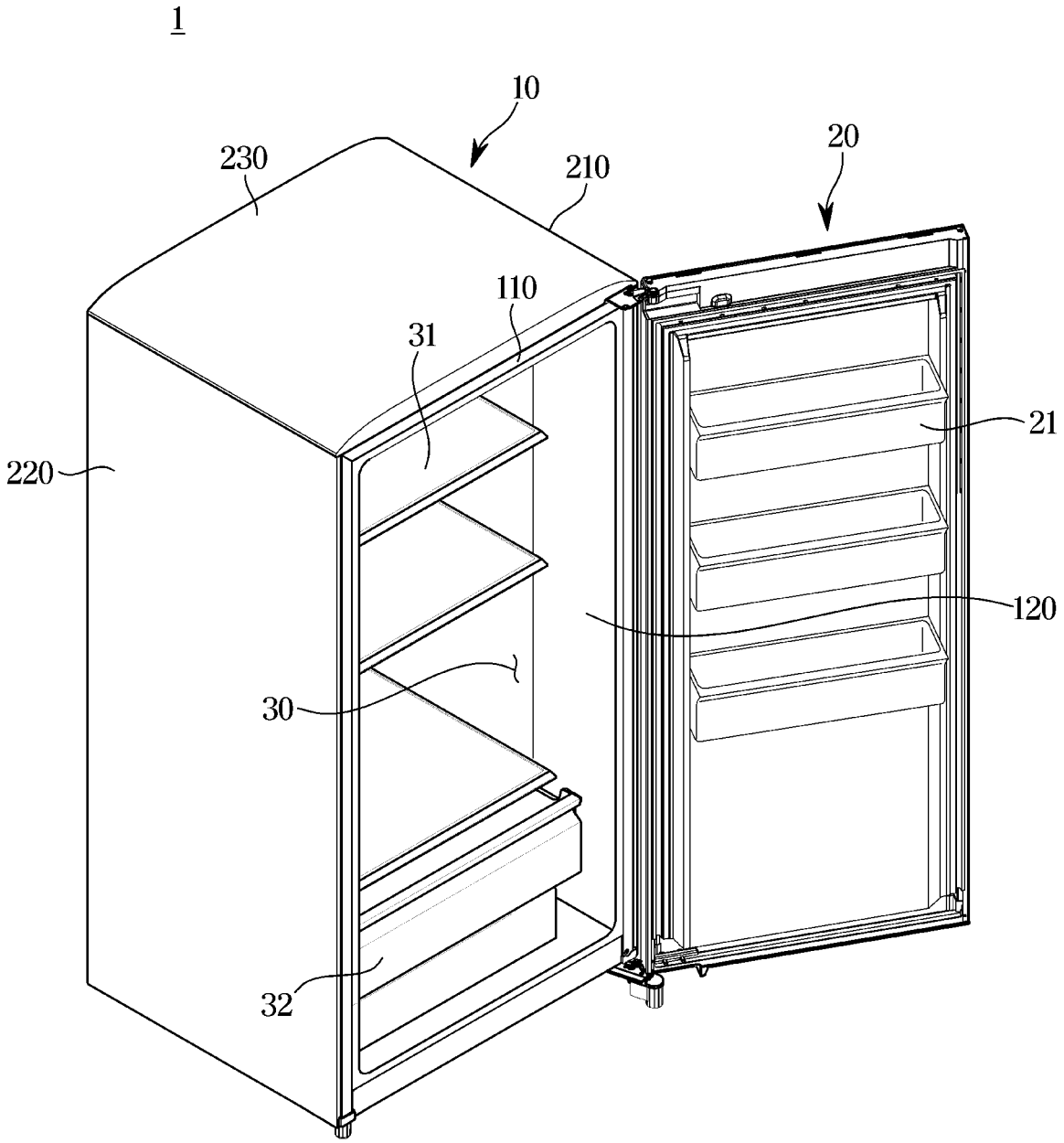
FIG. 1 is a perspective view of a refrigerator according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof. Shapes and sizes of elements in the drawings may be exaggerated for clear description.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Embodiments of the disclosure may be directed to providing a refrigerator capable of easily changing a design of a body of the refrigerator. According to an embodiment of the disclosure it may be possible to easily change a design of a body of a refrigerator because a side panel and an upper panel forming an exterior of the refrigerator are separable from a cabinet. According to an embodiment of the disclosure it may be possible to improve aesthetics of an exterior because an upper panel is hooked to a side panel, thereby preventing exposure of a coupling portion therebetween.

The disclosure will be described more fully hereinafter with reference to the accompanying drawings.

FIG. 1 is a perspective view of a refrigerator according to one embodiment of the present disclosure.

Referring to FIG. 1, a refrigerator 1 may include a body 10, a storage compartment 30 arranged inside the body 10, a door 20 configured to open and close the storage compartment 30, and a cold air supply device (not shown) configured to supply cold air to the storage compartment 30.

Figure 2:
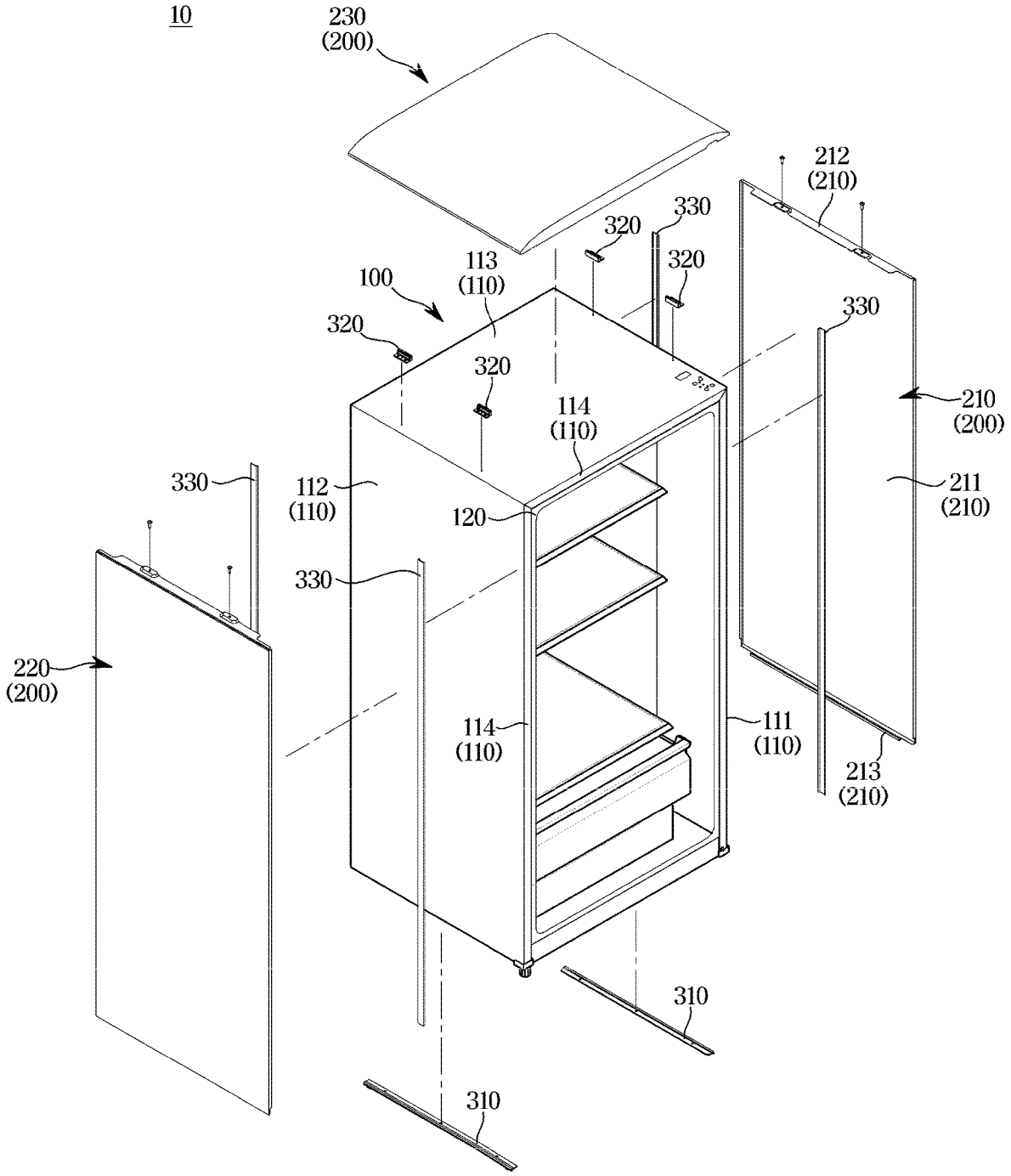
FIG. 2 is an exploded view of a body shown in FIG. 1 according to an embodiment of the disclosure.

The body 10 may include a cabinet 100 (FIG. 2) and a cabinet panel 200 (FIG. 2).

Particularly, the cabinet 100 may include an inner case 120 forming the storage compartment 30, an outer case 110 coupled to an outside of the inner case 120 to form an exterior, and a body insulating material (not shown) foamed between the inner case 120 and the outer case 110 to insulate the storage compartment 30.

Further, the cabinet panel 200 may include a plurality of side panels 210 and 220, and an upper panel 230 that are coupled to the outside of the outer case 110. A detail description of the body 10 will be described later.

The cold air supply device may generate cold air by using a refrigerant circulation cycle in which a refrigerant is compressed, condensed, expanded, and evaporated.

It is described that the refrigerator 1 according to one embodiment of the present disclosure includes a single storage compartment 30, but the number of the storage compartments 30 is not limited thereto.

The storage compartment 30 may be used as a refrigerating compartment or a freezing compartment. The storage compartment 30 may be opened and closed by the door 20. It is described that the refrigerator 1 according to one embodiment of the present disclosure includes a single door 20 to open and close a single storage compartment 30, but the number of the doors 20 is not limited thereto.

That is, the type of refrigerator 1 is not limited to the refrigerator 1 according to one embodiment of the present disclosure, and the disclosure may be applied to various types of refrigerators such as a Top Mounted Freezer (TMF) refrigerator, a Bottom Mounted Freezer (BMF) refrigerator, a French Door Refrigerator (FDR), and a Side by Side (SBS) refrigerator.

A door shelf 21 provided to store food may be provided on a rear surface of the door 20. The door shelf 21 may be supported by shelf supports (not shown) extending from the door 20 to support the door shelf 21 on both left and right sides of the door shelf 21.

A shelf 31 may be arranged inside the storage compartment 30. Various types of food may be placed on the shelf 31. A drawer 32 may be arranged below the storage compartment 30. The drawer 32 may be provided to be drawn forward to store food or the like.

FIG. 2 is an exploded view of a body shown in FIG. 1.

The body 10 may include the cabinet 100 and the cabinet panel 200.

The cabinet 100 may include the inner case 120, the outer case 110, and the body insulating material (not shown). The body insulating material (not shown) may be foamed between the inner case 120 and the outer case 110 to insulate the storage compartment 30.

The storage compartment 30 may be formed inside the inner case 120. The inner case 120 may include a resin material.

The outer case 110 may include a first side surface 111 and a second side surface 112, an outer case upper surface 113 and an outer case front surface 114. The first side surface 111 may be provided as a right surface of the outer case 110 with respect to the front side. The second side surface 112 may be provided as a left surface of the outer case 110 with respect to the front side. The first side surface 111 and the second side surface 112 may be provided as outer surfaces of the outer case 110. The outer case front surface 114 may be provided on the same plane as the front surface of the inner case 120. Together with the inner case 120, the outer case front surface 114 may form a front exterior of the cabinet 100. The outer case 110 may be formed of a steel material. However, the material of the outer case 110 is not limited thereto.

The cabinet panel 200 may include a first side panel 210, a second side panel 220 and an upper panel 230.

The first side panel 210 may be coupled to an outside of the first side surface 111 of the outer case 110. The second side panel 220 may be coupled to an outside of the second side surface 112 of the outer case 110.

The upper panel 230 may be coupled to the first side panel 210 and the second side panel 220 to cover a portion of an upper end of the first side panel 210 and the second side panel 220. The upper panel 230 may be provided to cover the outer case upper surface 113.

Accordingly, the cabinet panel 200 may be provided to form the exterior of the body 10. Particularly, the cabinet panel 200 may be provided to form the left surface, the right surface and the upper surface of the body 10 of the refrigerator 1, respectively. A detailed structure of the cabinet panel 200 will be described later.

The body 10 may include a panel fixing trim 310, a panel fixing bracket 320 and a magnet 330.

The panel fixing trim 310 may be coupled to a bottom surface of the cabinet 100. The panel fixing trim 310 may be provided in plurality so as to be inserted into one end of the first side panel 210 and the second side panel 220. Particularly, the panel fixing trim 310 may be coupled to a lower side of the cabinet 100 to support a lower end of the first side panel 210 and the second side panel 220.

The panel fixing bracket 320 may be coupled to the upper surface of the cabinet 100. Particularly, the panel fixing bracket 320 may be coupled to the outer case upper surface 113 of the outer case 110. The panel fixing bracket 320 may be provided in plurality. FIG. 2 illustrates that four panel fixing brackets 320 are provided, but the number of the panel fixing brackets 320 is not limited thereto.

An upper end of the first side panel 210 and the second side panel 220 may be coupled to the panel fixing bracket 320. A detailed configuration thereof will be described later.

The magnet 330 may be arranged between the outer case 110 and the side panel 210. Particularly, the magnet 330 may be arranged between the first side surface 111 and the first side panel 210 of the outer case 110.

Alternatively, the magnet 330 may be arranged between the second side surface 112 of the outer case 110 and the second side panel 220.

The magnet 330 restrains the outer case 110, the first side panel 210, and the second side panel 220 by magnetic force, so as to prevent a movement of the first side panel 210 and the second side panel 220.

In addition, although not shown in the drawing, a separate buffering member may be inserted between the outer case 110 and the first side panel 210, and between the outer case 110 and the second side panel 220 so as to prevent the deformation of the first side panel 210 and the second side panel 220. The first side panel 210 and the second side panel 220 may be formed to include a steel material. However, the materials of the first side panel 210 and the second side panel 220 are not limited thereto.

Figure 3:
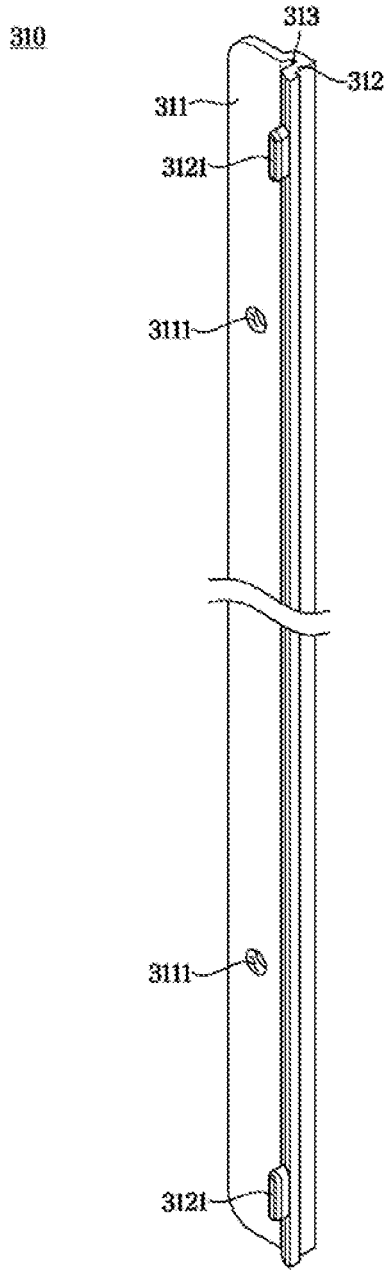
FIG. 3 is a view illustrating a panel fixing trim shown in FIG. 2 according to an embodiment of the disclosure.

FIG. 3 is a view illustrating a panel fixing trim shown in FIG. 2.

Referring to FIG. 3, the panel fixing trim 310 may include a coupling flange 311, a support flange 312, and a support groove 313.

The panel fixing trim 310 may extend along a front and rear direction of the refrigerator 1.

The coupling flange 311 may be in contact with and coupled to the bottom surface of the cabinet 100. The coupling flange 311 may extend in a direction substantially parallel to the bottom surface of the cabinet 100.

The coupling flange 311 may include a cabinet coupling hole 3111. By inserting a separate fastening member F into the cabinet coupling hole 3111, the coupling flange 311 may be coupled to the bottom surface of the cabinet 100.

The support flange 312 may extend from the coupling flange 311. Particularly, the support flange 312 may extend outward from the coupling flange 311. The support flange 312 may extend downward from the coupling flange 311 to have a predetermined height.

The support flange 312 may include a guide protrusion 3121 protruding downward from the support flange 312. The guide protrusion 3121 may protrude outward from the support flange 312 and be inserted into a trim receiving member 2132 of the side panel 210 to be described later. The guide protrusion 3121 may be provided to allow the side panel 210 to be coupled to the panel fixing trim 310 in place.

In addition, the guide protrusion 3121 may be provided to prevent the side panel 210 from being separated from the panel fixing trim 310.

The support groove 313 may be formed at a portion in which the coupling flange 311 and the support flange 312 meet. The support groove 313 may be provided to allow a hook member 2135 (refer to FIG. 5) of the side panel 210, which is described later, to be inserted thereinto and to allow one end of the side panel 210 to be fixed to the outer case 110.

A detailed coupling process between the panel fixing trim 310 and the side panel 210 will be described later.

Figure 4:
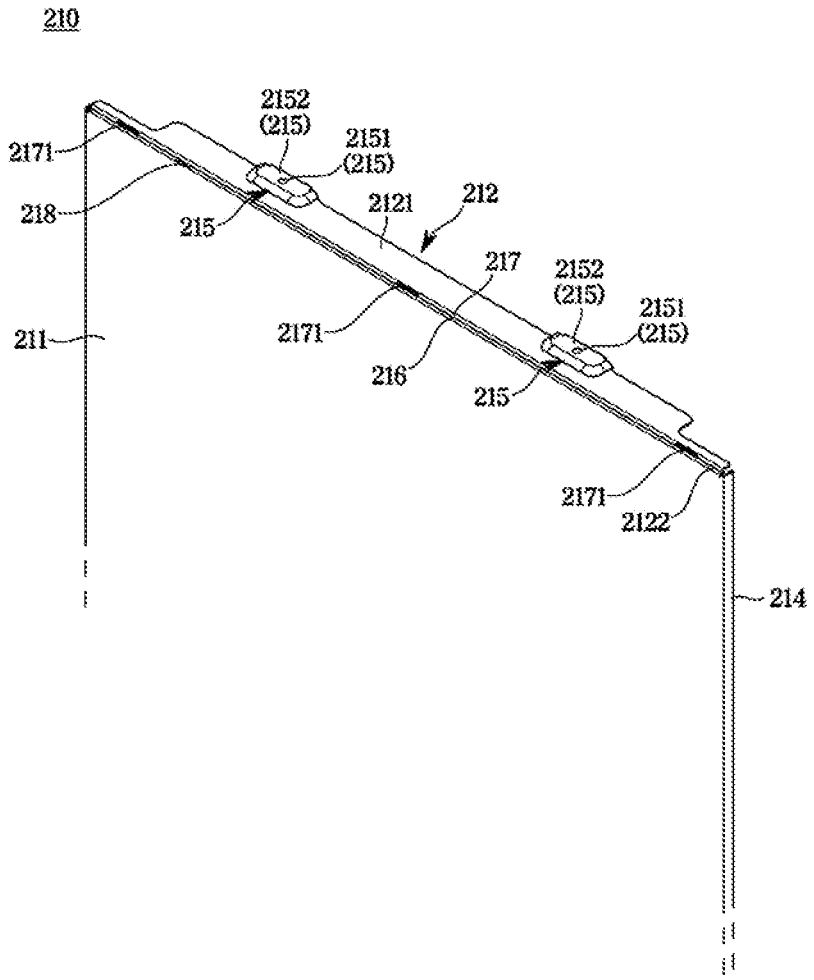
FIG. 4 is a view illustrating an upper portion of a first side panel shown in FIG. 2 according to an embodiment of the disclosure.
Figure 5:
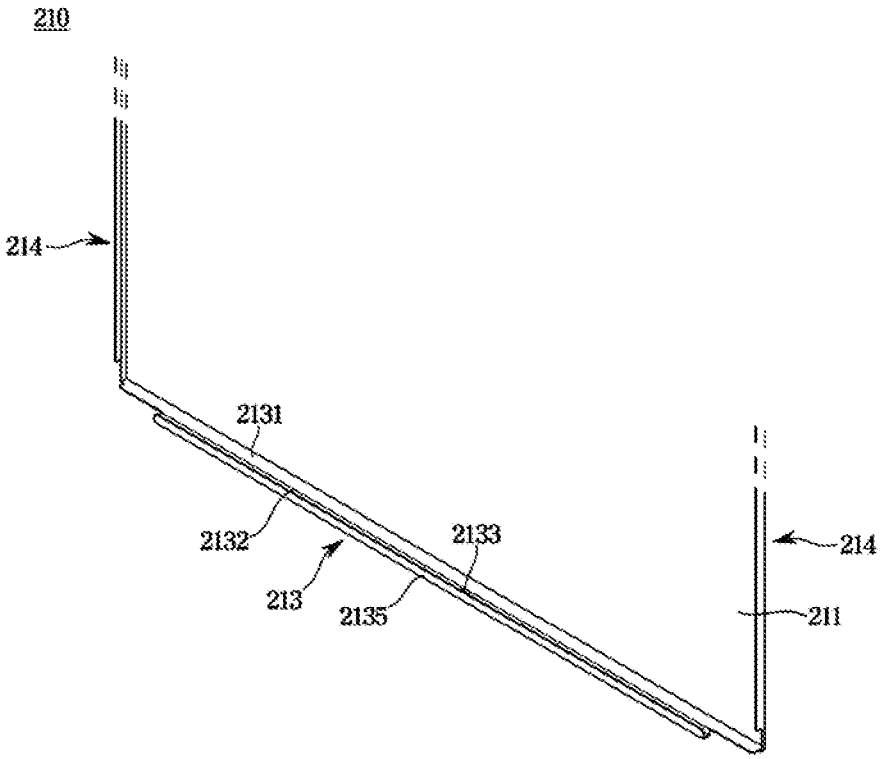
FIG. 5 is a view illustrating a lower portion of the first side panel shown in FIG. 2, when viewed from an inner side according to an embodiment of the disclosure.

FIG. 4 is a view illustrating an upper portion of a first side panel shown in FIG. 2. FIG. 5 is a view illustrating a lower portion of the first side panel shown in FIG. 2, when viewed from an inner side.

The first side panel 210 and the second side panel 220 may have the same shape and be provided symmetrically. Therefore, a detailed configuration of the first side panel 210 will be described below. Because the second side panel 220 is provided to include the same configuration, a description thereof will be omitted. Hereinafter the first side panel 210 will be referred to as a side panel.

Referring to FIG. 4, the side panel 210 may include a main body 211 and a cabinet coupling body 212 that is bent at one end of the main body 211.

The cabinet coupling body 212 may be coupled to the cabinet 100. Particularly, the cabinet coupling body 212 may be coupled to the upper surface of the cabinet 100. The cabinet coupling body 212 may be provided by being bent at an upper end of the main body 211.

The cabinet coupling body 212 may include a first flange 2121 and a second flange 2122.

The first flange 2121 may be provided to be seated on the upper surface of the cabinet 100. The first flange 2121 may extend substantially horizontally. The first flange 2121 and the main body 211 may be provided substantially vertically.

The first flange 2121 may include a bracket coupler 215. The bracket coupler 215 may cover a part of the panel fixing bracket 320 and be coupled to the panel fixing bracket 320. The bracket coupler 215 may be provided in a shape that is pressed upward from the first flange 2121. Accordingly, the panel fixing bracket 320 may be received under the bracket coupler 215. In addition, the side panel 210 may be coupled to the panel fixing bracket 320 in place.

The bracket coupler 215 may include a bracket insert 2152 and a bracket coupling hole 2151.

The bracket coupling hole 2151 may be formed at the center of the bracket coupler 215 and provided to allow the fastening member F to be inserted thereinto. Accordingly, the panel fixing bracket 320 and the side panel 210 may be coupled.

The bracket insert 2152 may extend inwardly from the bracket coupler 215. The bracket insert 2152 may be inserted into a flange insertion space 323 of the panel fixing bracket 320 to be described later. Accordingly, it is possible to guide the proper position coupling of the bracket coupler 215 and the panel fixing bracket 320.

The second flange 2122 may be bent from the main body 211 and connected to the first flange 2121. Particularly, the second flange 2122 may be bent toward the inside of the main body 211. The second flange 2122 may be provided in a substantially inverted 'L' shape to form a seating space 218 in which one side portion of the upper panel 230 is seated.

The second flange 2122 may include a seating member 216 and an insert 217.

The seating member 216 is a portion in which one side portion of the upper panel 230 is seated, and may be provided substantially horizontally. The insert 217 may be provided as a part extending substantially perpendicular to the seating member 216. In other words, the seating member 216 may be provided to be connected to the main body 211. The insert 217 may be provided to be connected to the first flange 2121.

The second flange 2122 may include a fixing hole 2171. The fixing hole 2171 may be formed in the insert 217 of the second flange 2122. The fixing hole 2171 may be provided to allow a fixing protrusion 236 (refer to FIG. 6) of the upper panel 230, which is described later, to be inserted thereinto. Accordingly, the upper panel 230 and the side panel 210 may be coupled. A detailed configuration will be described later.

The side panel 210 may include a side flange 214 bent at a side end of the main body 211.

The side flange 214 may be provided to be bent so as to cover a separation space between the side surface of the outer case 110 and the side panel 210.

Referring to FIG. 5, the side panel 210 may include the main body 211 and a trim coupling body 213 bent at the other end of the main body 211.

The trim coupling body 213 may be provided to be coupled to the panel fixing trim 310. Particularly, the trim coupling body 213 may be bent at the lower end of the main body 211.

The trim coupling body 213 may include a lower flange 2131 and the trim receiving member 2132.

The lower flange 2131 may be bent from the main body 211 and extend inwardly of the side panel 210. The lower flange 2131 may be provided to cover the separation space, which is between the outer case 110 and the side panel 210, from the lower side.

The trim receiving member 2132 may be formed by being bent from the lower flange 2131. Particularly, the trim receiving member 2132 may be formed by being bent in a '⊏' shape to include a receiving space 2133 in which the support flange 312 of the panel fixing trim 310 is received.

The trim receiving member 2132 may include the hook member 2135 provided to be inserted into the support groove 313 of the panel fixing trim 310. The hook member 2135 may extend substantially parallel to the main body 211.

The position of the side panel 210 may be fixed by hooking the lower end of the side panel 210 to the panel fixing trim 310 through the trim coupling body 213. Detail description thereof will be described later.

Figure 6:
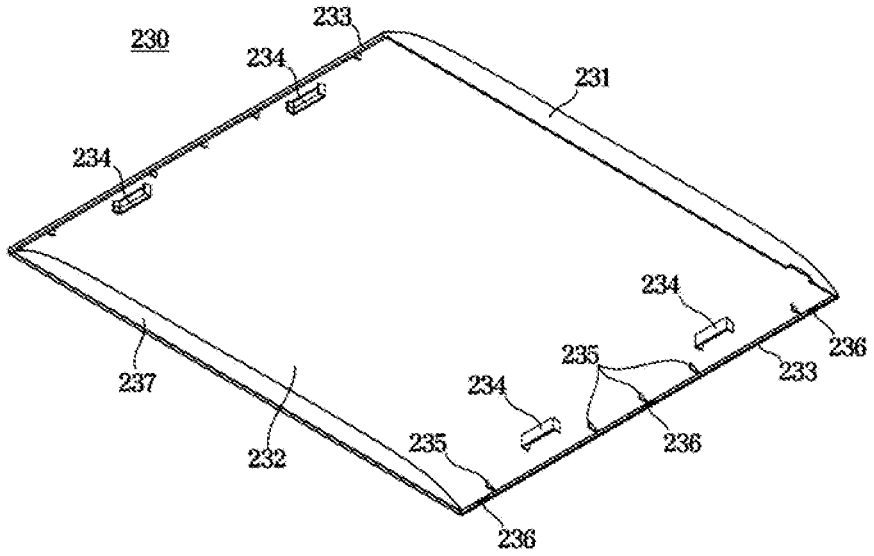
FIG. 6 is a bottom perspective view of an upper panel shown in FIG. 2 according to an embodiment of the disclosure.
Figure 7:
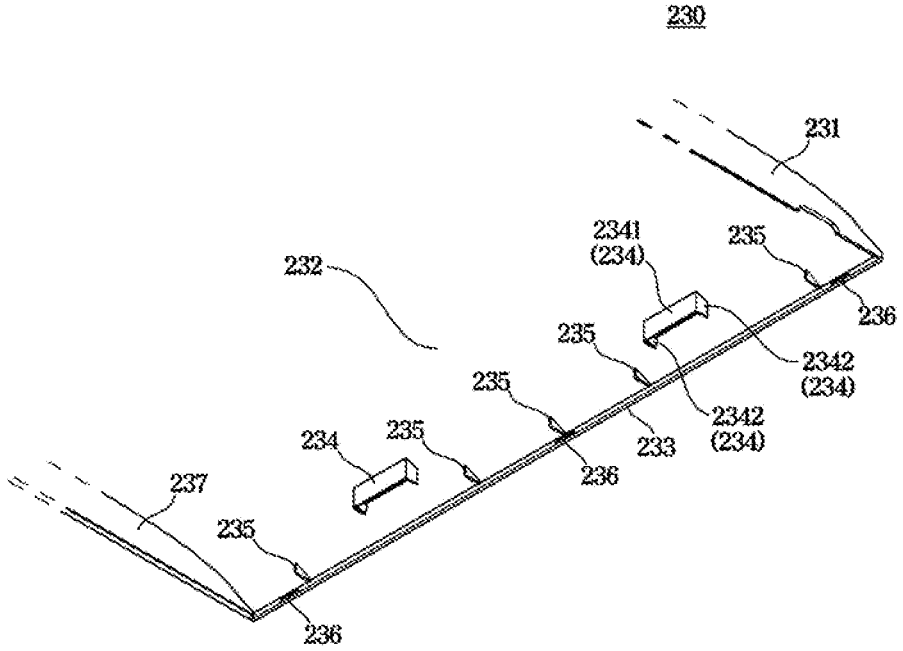
FIG. 7 is an enlarged view of a right side of the upper panel shown in FIG. 6 according to an embodiment of the disclosure.
Figure 8:
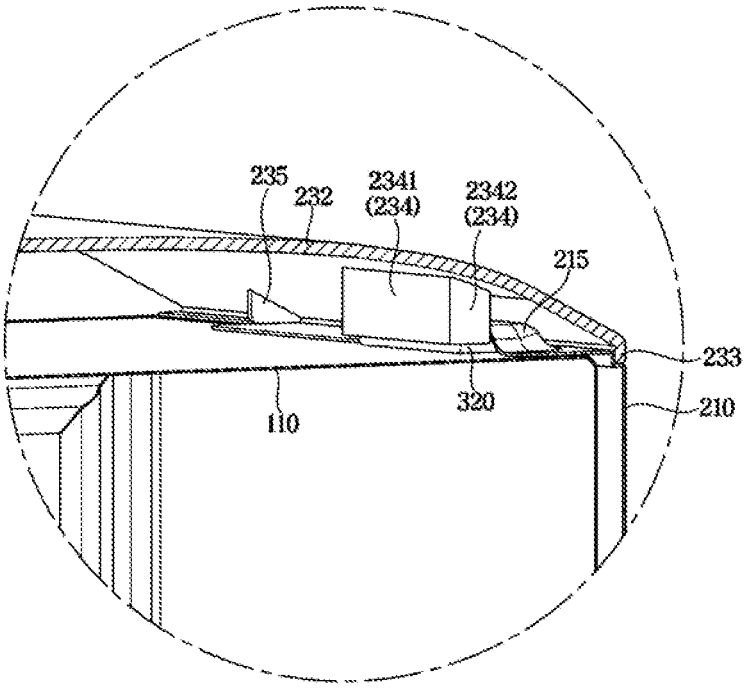
FIG. 8 is a cross-sectional perspective view illustrating a state in which the upper panel of FIG. 2 is mounted on an upper portion of a cabinet according to an embodiment of the disclosure.

FIG. 6 is a bottom perspective view of an upper panel shown in FIG. 2. FIG. 7 is an enlarged view of a right side of the upper panel shown in FIG. 6. FIG. 8 is a cross-sectional perspective view illustrating a state in which the upper panel of FIG. 2 is mounted on an upper portion of a cabinet.

As illustrated in FIGS. 6 to 8, the upper panel 230 may include a front cover 231, a rear cover 237, an upper cover 232, and a pair of side covers 233.

The front cover 231 may be formed in front of the upper panel 230 to cover a separation space between the upper panel 230 and the outer case 110. The rear cover 237 may be formed at the rear of the upper panel 230 to cover a separation space between the upper panel 230 and the outer case 110.

The upper cover 232 may be provided to form an upper surface of the upper panel 230. The upper cover 232 may be provided to cover the upper portion of the cabinet 100.

The side cover 233 may be provided to extend downward from both sides of the upper cover 232. The side cover 233 may be provided to be seated on the upper end of the side panel 210. The side cover 233 may be provided substantially parallel to the main body 211 of the side panel 210.

The upper panel 230 may include a bracket cover rib 234 and a support rib 235.

The bracket cover rib 234 may be provided to surround the panel fixing bracket 320 mounted on the upper surface of the cabinet 100. Particularly, the bracket cover rib 234 may include a first cover 2341 and a second cover 2342.

The first cover 2341 may be provided to be in contact with the rear surface of the panel fixing bracket 320. The second cover 2342 may be provided to be in contact with both side surfaces of the panel fixing bracket 320.

The bracket cover rib 234 may extend inwardly from the upper cover 232 of the upper panel 230. FIG. 7 illustrates that two bracket cover ribs 234 are provided, but the number of the bracket cover ribs 234 is not limited thereto. The number of the bracket cover ribs 234 may be provided in accordance with the number of the panel fixing brackets 320.

The support rib 235 may be provided to be in contact with the upper surface of the side panel 210. The support rib 235 may extend inwardly from the upper cover 232 of the upper panel 230.

The upper panel 230 is provided with the bracket cover rib 234 and the support rib 235, and thus after the upper panel 230 and the side panels 210 are coupled, a vertical and horizontal movement of the upper panel 230 is prevented. In addition, the upper panel 230 may be easily coupled to the side panel 210 in place.

The upper panel 230 may include the fixing protrusion 236.

The fixing protrusion 236 may extend inwardly from one side portion of the upper panel 230. The fixing protrusion 236 may be provided to be inserted into the side panel 210. Particularly, the fixing protrusion 236 may extend inwardly from the side cover 233 of the upper panel 230. The fixing protrusion 236 may be provided to be inserted into the fixing hole 2171 of the side panel 210.

Accordingly, the upper panel 230 may be coupled to the side panel 210 without a separate fastening member. However, it is not limited thereto, and the upper panel 230 and the side panel 210 may be screwed to each other.

Figure 9:
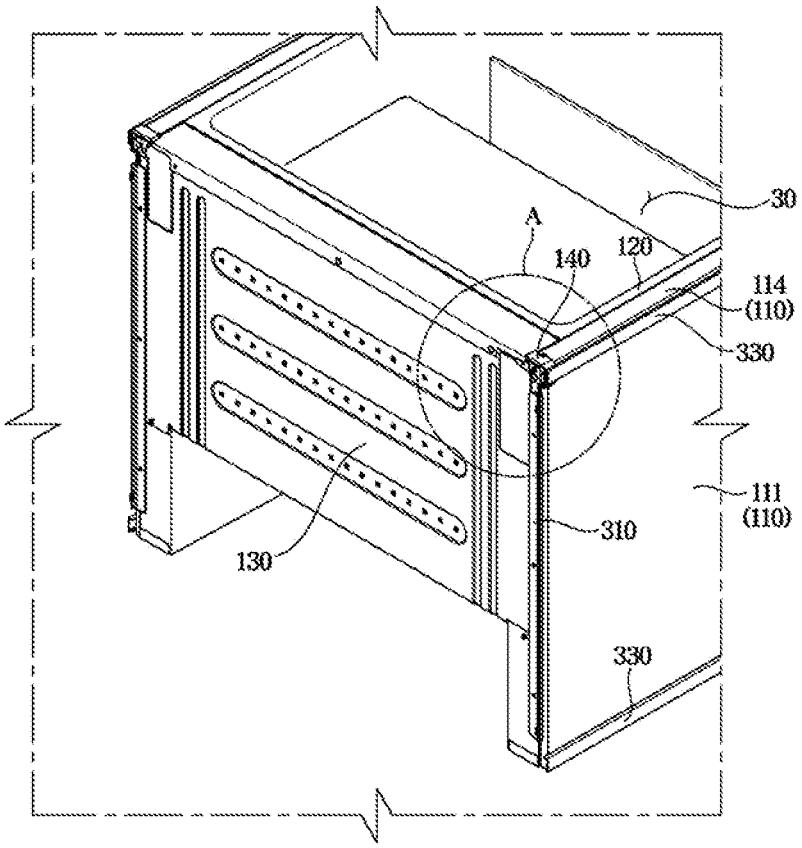
FIG. 9 is a view illustrating a state in which a side panel is not coupled to the refrigerator shown in FIG. 1, when viewed from a bottom surface according to an embodiment of the disclosure.
Figure 10:
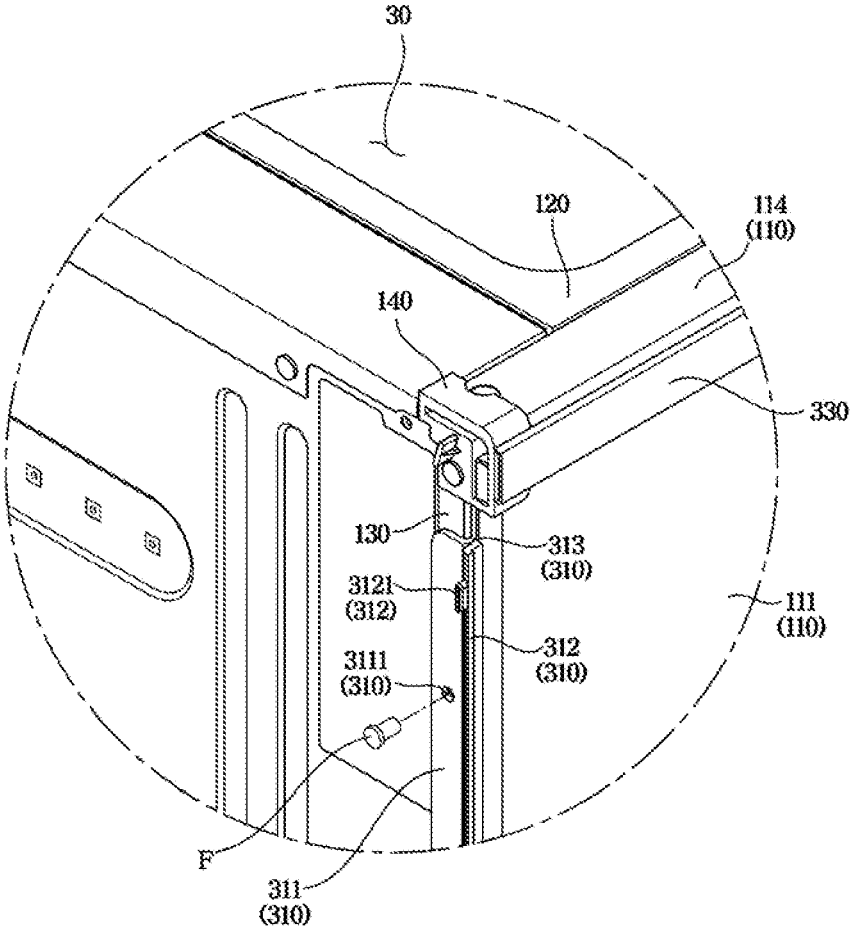
FIG. 10 is an enlarged view of a marked part of FIG. 9 according to an embodiment of the disclosure.
Figure 11:
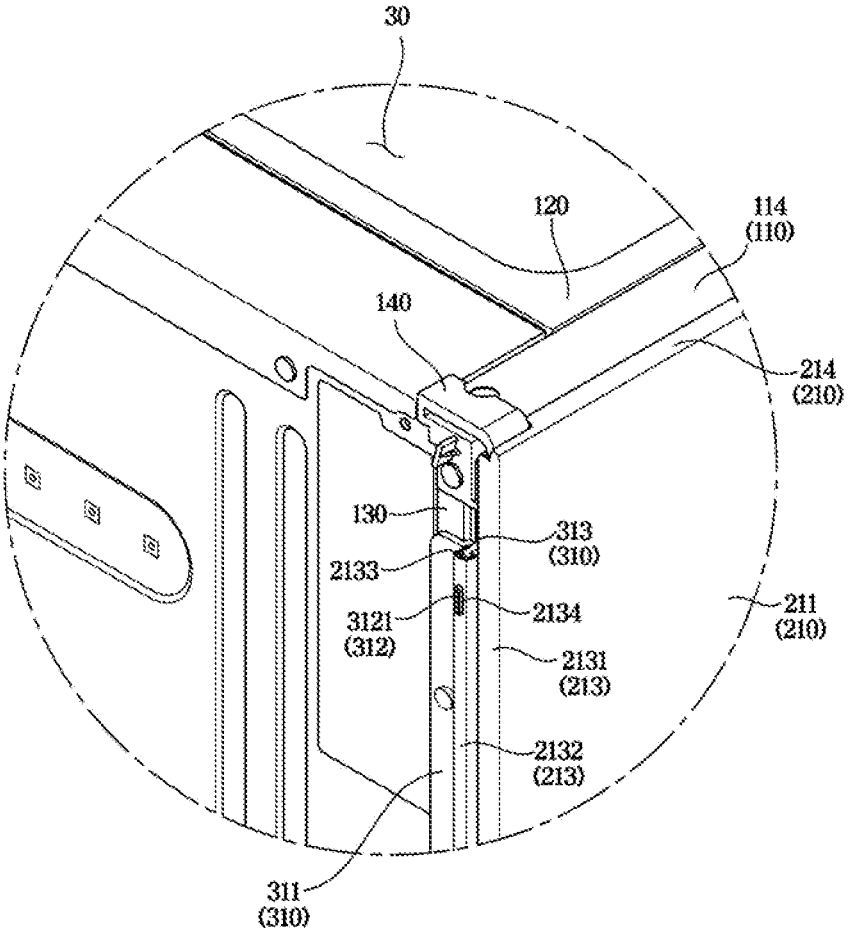
FIG. 11 is a view illustrating a state in which the side panel is coupled to the panel fixing trim of FIG. 10 according to an embodiment of the disclosure.

FIG. 9 is a view illustrating a state in which a side panel is not coupled to the refrigerator shown in FIG. 1, when viewed from a bottom surface. FIG. 10 is an enlarged view of a marked part of FIG. 9. FIG. 11 is a view illustrating a state in which the side panel is coupled to the panel fixing trim of FIG. 10.

Hereinafter a structure in which the side panel 210 is coupled to the lower end of the cabinet 100 will be described with reference to FIGS. 9 to 11.

Referring to FIG. 9, the cabinet 100 of the body 10 may further include a bottom plate 130 and a cover cap 140.

The bottom plate 130 may be provided to form the bottom surface of the cabinet 100 by being coupled to the outer case 110. However, it is not limited thereto, and the bottom plate 130 and the outer case 110 may be formed integrally.

The cover cap 140 may be provided to cover a gap between the bottom plate 130 and the outer case 110. The cover cap 140 may be mounted on a front corner of the refrigerator 1, respectively.

Referring to FIGS. 9 and 10, the panel fixing trim 310 may be coupled to the bottom surface of the cabinet 100.

Particularly, the fastening member F may be inserted into the cabinet coupling hole 3111 formed in the coupling flange 311 of the panel fixing trim 310 and thus the panel fixing trim 310 and the cabinet 100 may be coupled.

In addition, because the outer case 110 is formed of a steel material, the magnet 330 may be attached to the outside of the outer case 110.

Referring to FIG. 11, the side panel 210 may be supported by the panel fixing trim 310.

Particularly, the trim receiving member 2132 of the side panel 210 may receive the support flange 312 of the panel fixing trim 310. In other words, the support flange 312 of the panel fixing trim 310 may be received in the receiving space 2133 of the trim receiving member 2132.

Further, the hook member 2135 of the trim receiving member 2132 may be inserted into the support groove 313 of the panel fixing trim 310. In addition, the guide protrusion 3121 of the panel fixing trim 310 may be inserted into a protrusion insertion hole 2134 formed on the bottom surface of the trim receiving member 2132.

Accordingly, the lower end of the side panel 210 may be fixed to the panel fixing trim 310. Together with the inner case 120 and the outer case front surface 114, the side flange 214 of the side panel 210 may form the front exterior of the body 10. In addition, the main body 211 of the side panel 210 may form the side exterior of the body 10.

Figure 12:
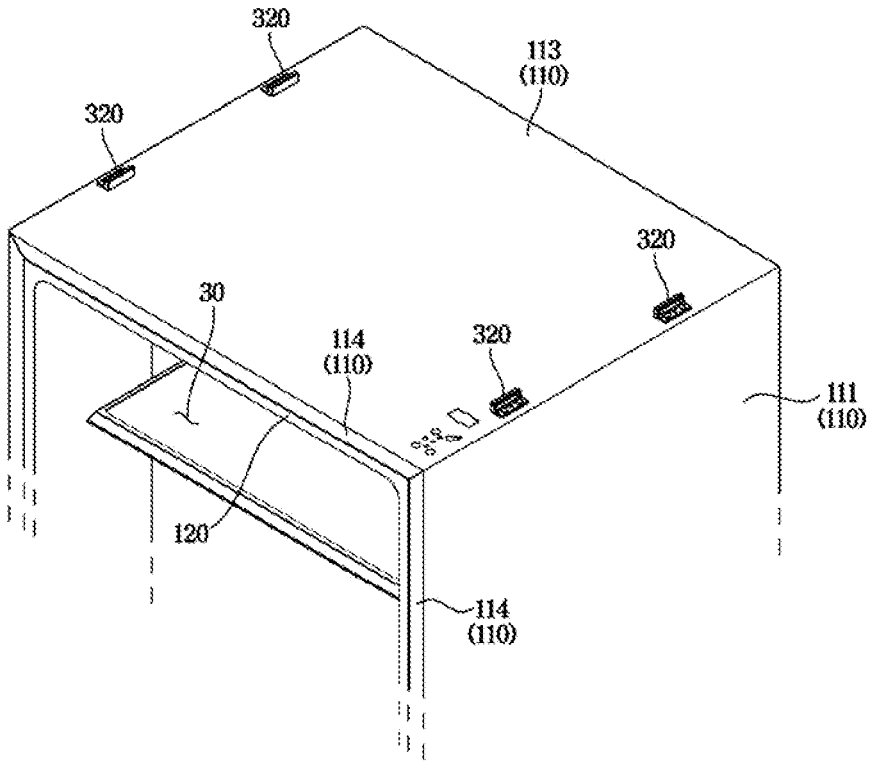
FIG. 12 is a view illustrating a state in which a panel fixing bracket is coupled to the cabinet of FIG. 2, when viewed from an upper side according to an embodiment of the disclosure.
Figure 13:
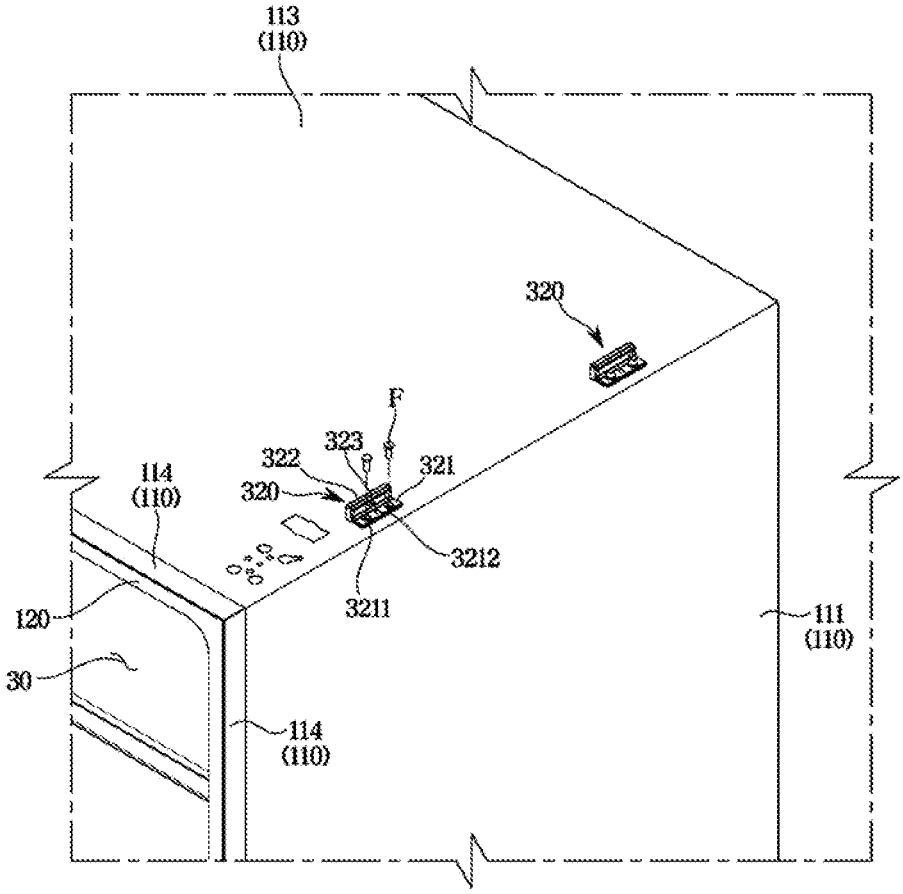
FIG. 13 is an enlarged view of a right side of FIG. 12 according to an embodiment of the disclosure.
Figure 14:
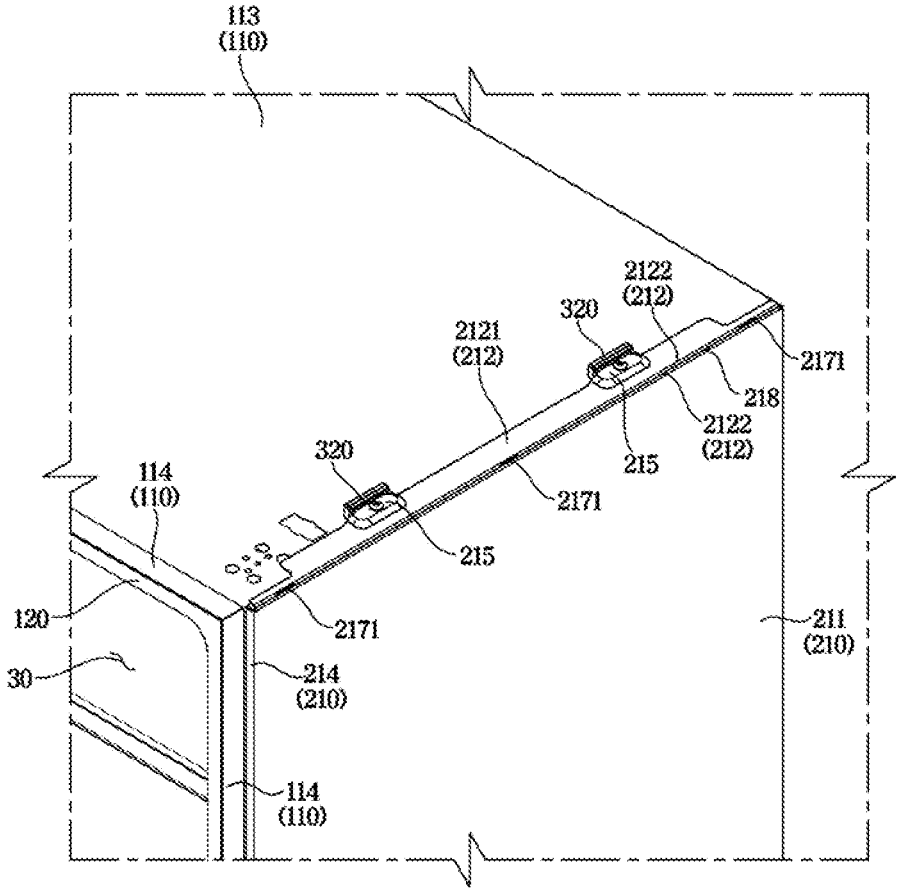
FIG. 14 is a view illustrating a state in which the side panel is coupled to the panel fixing bracket according to an embodiment of the disclosure.
Figure 15:
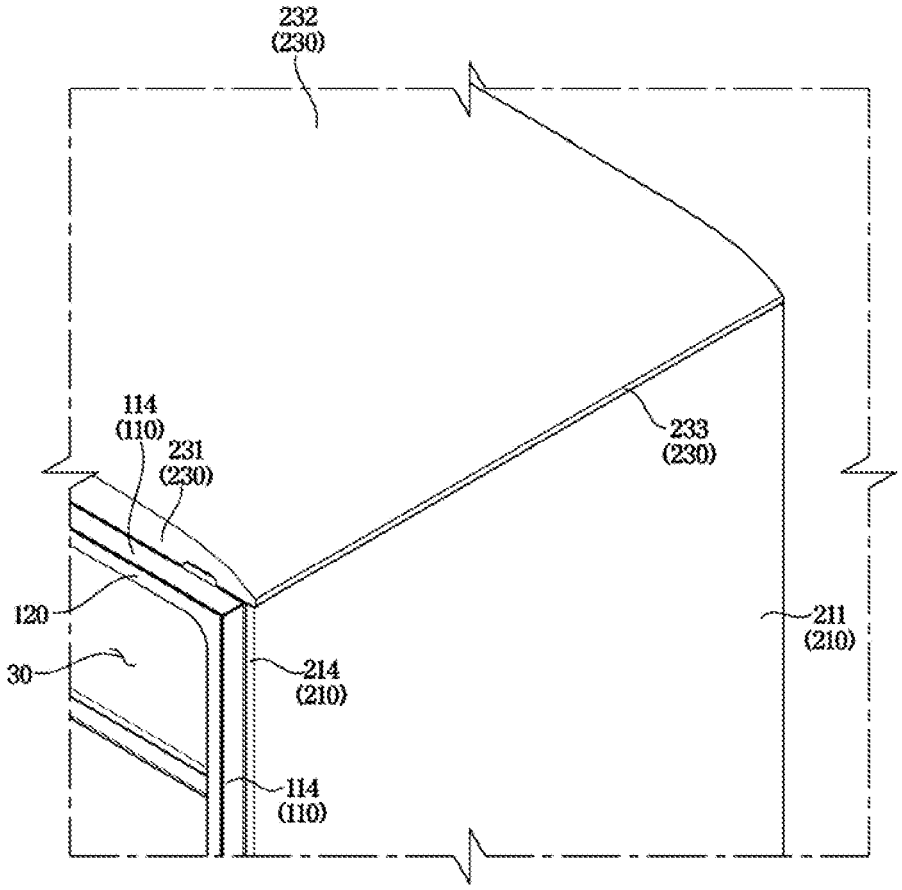
FIG. 15 is a view illustrating a state in which the upper panel is coupled to the side panel of FIG. 14 according to an embodiment of the disclosure.

FIG. 12 is a view illustrating a state in which a panel fixing bracket is coupled to the cabinet of FIG. 2, when viewed from an upper side. FIG. 13 is an enlarged view of a right side of FIG. 12. FIG. 14 is a view illustrating a state in which the side panel is coupled to the panel fixing bracket. FIG. 15 is a view illustrating a state in which the upper panel is coupled to the side panel of FIG. 14.

Hereinafter the structure in which the side panel 210 is coupled to the upper end of the cabinet 100, and the coupling of the upper panel 230 and the side panel 210 will be described with reference to FIGS. 12 to 15.

Referring to FIGS. 12 and 13, the panel fixing bracket 320 may be coupled to the upper surface of the cabinet 100. An upper end of the side panel 210 may be fixed to the cabinet 100 through the panel fixing bracket 320.

The panel fixing bracket 320 may include a fastening member 321 seated on the upper surface of the cabinet 100 and an extension member 322 extending upward.

The fastening member 321 may include a cabinet fastening hole 3211 and a panel fastening hole 3212.

As the fastening member F is inserted into the cabinet fastening hole 3211, the panel fixing bracket 320 and the cabinet 100 may be coupled. Particularly, the outer case upper surface 113 of the outer case 110 and the panel fixing bracket 320 may be coupled to each other.

The panel fastening hole 3212 may be provided between the cabinet fastening holes 3211, and thus the side panel 210 and the panel fixing bracket 320 may be coupled.

The extension member 322 may be provided to be in contact with the bracket cover rib 234 of the upper panel 230. The flange insertion space 323 may be formed inside the extension member 322. Accordingly, the bracket insert 2152 formed in the bracket coupler 215 of the side panel 210 may be inserted into the flange insertion space 323.

Referring to FIGS. 13 and 14, the side panel 210 may be arranged on the lateral side of the cabinet 100. The side panel 210 may be provided to cover the first side surface 111 of the outer case 110. The first flange 2121 of the side panel 210 may be seated on the outer case upper surface 113 of the outer case 110. The bracket coupler 215 formed on the first flange 2121 may be provided to cover the fastening member 321 of the panel fixing bracket 320. The fastening member F may pass through the bracket coupling hole 2151 and the panel fastening hole 3212 of the bracket coupler 215, thereby coupling the panel fixing bracket 320 and the first flange 2121 of the side panel 210.

Referring to FIGS. 14 and 15, the upper panel 230 may cover the upper end of the side panel 210 and be coupled to the side panel 210. Particularly, the upper panel 230 may be provided to cover the cabinet coupling body 212 of the side panel 210.

As the fixing protrusion 236 of the upper panel 230 is inserted into the fixing hole 2171 of the side panel 210, the upper panel 230 may be coupled to the side panel 210. In addition, the side cover 233 of the upper panel 230 may be seated in the seating space 218 formed by the second flange 2122 of the side panel 210.

The front cover 231 of the upper panel 230 may be provided to cover a space, which is between the upper cover 232 of the upper panel 230 and the upper surface of the cabinet 100, from the front side.

Accordingly, the upper panel 230 and the side panel 210 may form the exterior of the body 10. Particularly, the upper panel 230 and the side panel 210 may form an exterior of the upper surface and the side surface of the body 10.

The upper panel 230 may cover the coupling structure between the side panel 210 and the cabinet 100, and the upper panel 230 and the side panel 210 may be hooked together. Therefore, the coupling portion may not be exposed to the outside. Accordingly, aesthetics of the exterior of the refrigerator 1 may be improved.

In addition, because the upper panel 230, the first side panel 210, and the second side panel 220 are detachably provided from the cabinet 100, it is possible to easily change the design according to the user's convenience.

Figure 16:
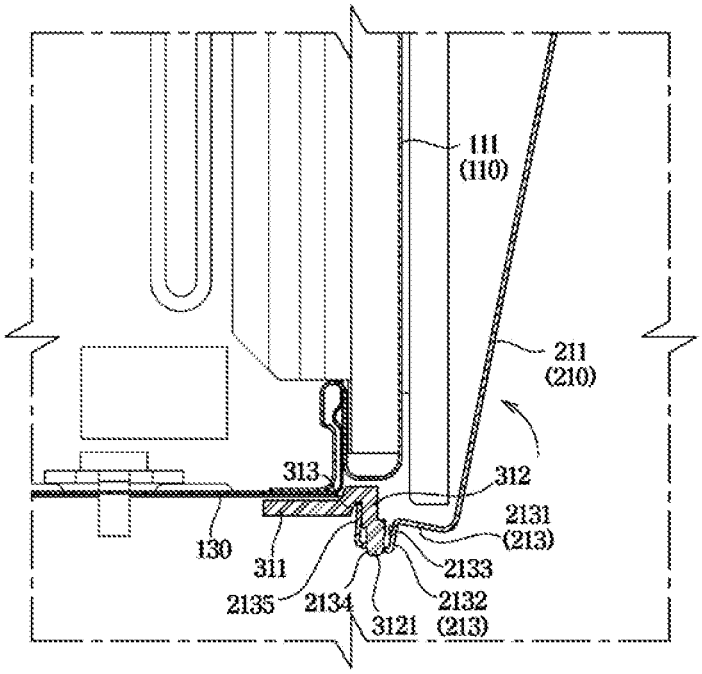
FIG. 16 is a cross-sectional view illustrating a state in which the side panel is mounted to the panel fixing trim according to an embodiment of the disclosure.
Figure 17:
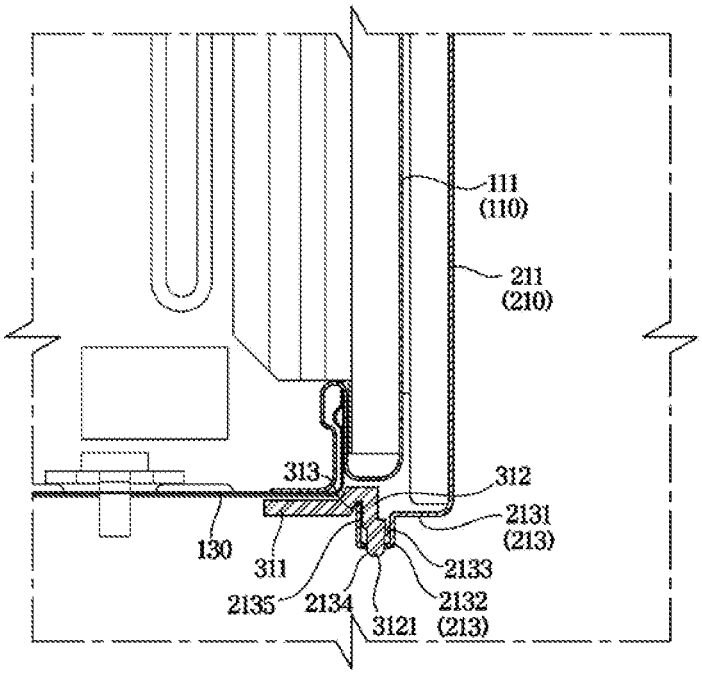
FIG. 17 is a cross-sectional view illustrating a state in which the side panel of FIG. 16 is mounted to the panel fixing trim according to an embodiment of the disclosure.
Figure 18:
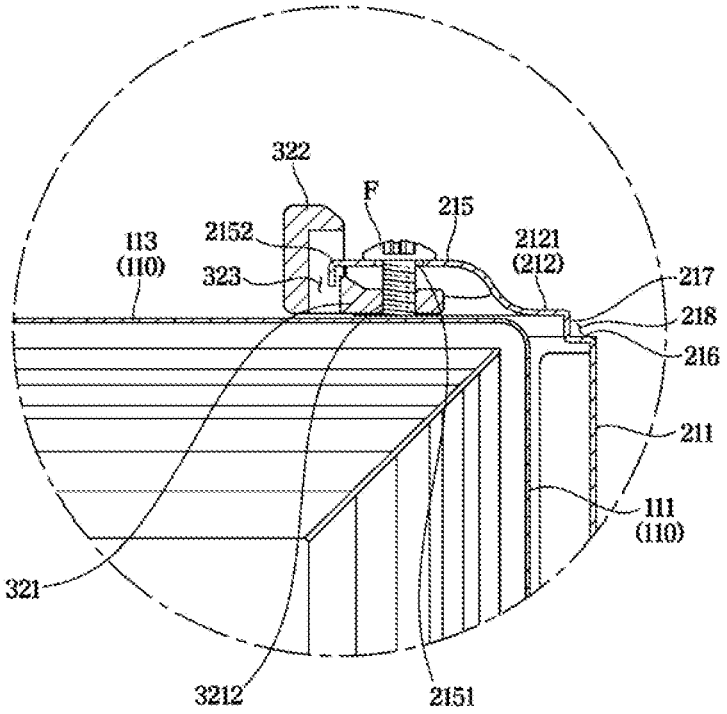
FIG. 18 is a cross-sectional view illustrating a state in which the side panel is mounted to the panel fixing bracket according to an embodiment of the disclosure.
Figure 19:
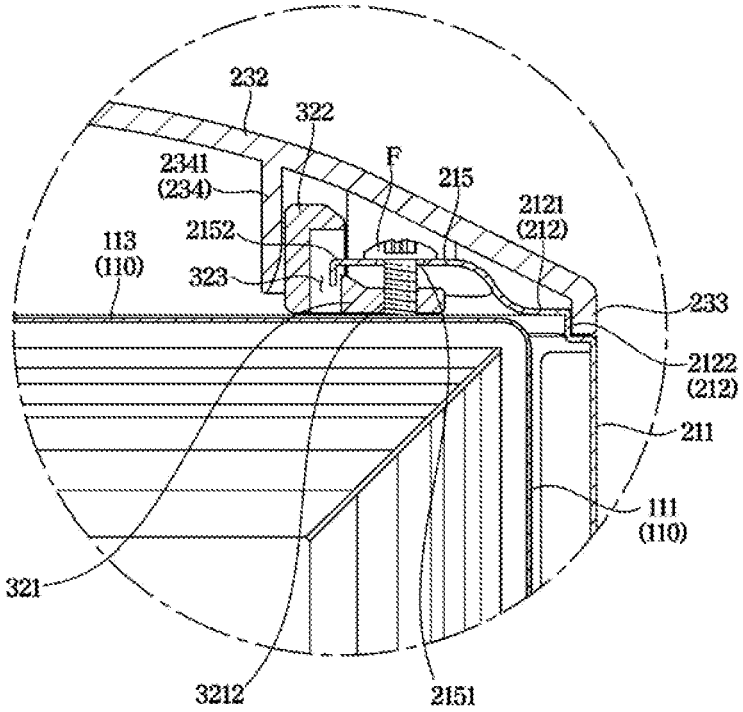
FIG. 19 is a cross-sectional view illustrating a state in which the upper panel is mounted in the drawing of FIG. 18 according to an embodiment of the disclosure.
Figure 20:
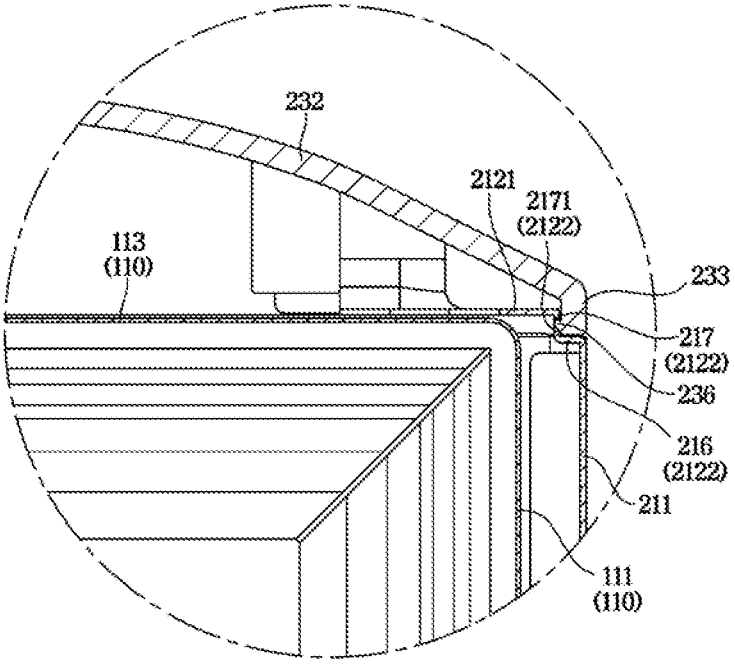
FIG. 20 is a cross-sectional view illustrating a coupling relationship between the upper panel and the side panel in a state in which the upper panel is mounted according to an embodiment of the disclosure.

FIG. 16 is a cross-sectional view illustrating a state in which the side panel is mounted to the panel fixing trim. FIG. 17 is a cross-sectional view illustrating a state in which the side panel of FIG. 16 is mounted to the panel fixing trim. FIG. 18 is a cross-sectional view illustrating a state in which the side panel is mounted to the panel fixing bracket. FIG. 19 is a cross-sectional view illustrating a state in which the upper panel is mounted in the drawing of FIG. 18. FIG. 20 is a cross-sectional view illustrating a coupling relationship between the upper panel and the side panel in a state in which the upper panel is mounted.

Hereinafter a process of coupling the side panel 210 and the upper panel 230 to the outside of the cabinet 100 will be described with reference to FIGS. 16 to 20.

Referring to FIGS. 16 and 17, the trim coupling body 213 of the side panel 210 may be hooked to the panel fixing trim 310.

Particularly, the hook member 2135 of the side panel 210 may be inserted into the support groove 313 formed between the coupling flange 311 and the support flange 312 of the panel fixing trim 310, and then the hook member 2135 may be supported.

Further, the guide protrusion 3121 extending downward from the support flange 312 of the panel fixing trim 310 may be inserted into the trim receiving member 2132 of the side panel 210. Particularly, the fixing protrusion 236 may be inserted into the protrusion insertion hole 2134 formed on the bottom surface of the trim receiving member 2132 of the side panel 210.

In addition, the support flange 312 of the side panel 210 may be received in the receiving space 2133 formed inside the trim receiving member 2132.

Accordingly, one end of the side panel 210 may be supported by interfering with the panel fixing trim 310. Particularly, the support flange 312 of the panel fixing trim 310 may be inserted into one end of the side panel 210 and extend toward the side panel 210 to support the side panel 210. Therefore, by rotating the side panel 210 in a state in which the lower end of the side panel 210 is hooked to the panel fixing trim 310, the side panel 210 may be changed from the state of FIG. 16 to the state of FIG. 17.

As shown in FIG. 18, the upper end of the side panel 210, which is not fixed to the counterpart, is coupled to the panel fixing bracket 320. Particularly, the bracket coupler 215 formed on the first flange 2121 of the side panel 210 is coupled to the panel fixing bracket 320. The fastening member F may be inserted through the bracket coupling hole 2151 of the bracket coupler 215 and the panel fastening hole 3212 formed in the fastening member 321 of the panel fixing bracket 320.

In addition, the bracket insert 2152 formed at the end of the bracket coupler 215 may be received in the flange insertion space 323 formed in the extension member 322 of the panel fixing bracket 320.

As shown in FIGS. 19 and 20, the upper panel 230 is coupled to the side panel 210. In a state in which the upper panel 230 is coupled to the side panel 210, the bracket cover rib 234 of the upper panel 230 may be in contact with the panel fixing bracket 320. Particularly, the first cover 2341 of the bracket cover rib 234 may be provided to be in contact with the extension member 322 of the panel fixing bracket 320.

At the same time, as shown in FIG. 20, the side cover 233 of the upper panel 230 may be seated in the seating space 218 of the side panel 210. At the same time, the fixing protrusion 236 extending inwardly from the side cover 233 of the upper panel 230 may be inserted into the fixing hole 2171 of the side panel 210. The fixing hole 2171 of the side panel 210 may be formed by being cut so as to allow the fixing protrusion 236 to be inserted thereinto. Accordingly, the upper panel 230 and the side panel 210 may be hooked to each other.

That is, as shown in FIGS. 16 to 20, the side panel 210 may be fixed to the outside of the cabinet 100 in such a way that one end of the side panel 210 is hooked to the panel fixing trim 310 and the other end is coupled to the cabinet 100. In addition, the upper panel 230 may be fixed to the side panel 210 by inserting the fixing protrusions 236 formed on both side covers 233 of the upper panel 230 into the fixing holes 2171 of the side panel 210.

In addition, in the description of the refrigerator 1 according to one embodiment of the present disclosure described above, it is described that the lower end of the side panel 210 is hooked and the upper end is screwed by the fastening member F, but is not limited thereto.

For example, when the panel fixing trim 310 is coupled to the upper portion of the cabinet 100 and the panel fixing bracket 320 is coupled to the lower portion of the cabinet 100, the upper end of the side panel 210 may be hooked and the lower end may be screwed by the fastening member F.

In addition, it is not limited thereto, and the side panel 210 may be provided in a structure in which both upper and lower ends are hooked together, or in a structure in which both upper and lower ends are screw-coupled.

In addition, instead of one end of the side panel 210 being screw-coupled, the side panel 210 may be fixed to the cabinet 100 by a separate magnet 330 or the side panel 210 may be fixed to the cabinet 100 by a separate adhesive member.

In addition, in the refrigerator 1 according to one embodiment of the present disclosure, as the cabinet panel is coupled to the outside of the cabinet 100, the upper and side surfaces of the door 20 and the cabinet 100 panel may be arranged on the same plane.

That is, the cabinet 100 arranged inside the cabinet panel 200 may have a less width than the door 20 and have a lower height than the door 20. Accordingly, a sense of unity between the door 20 and the body 10 may be formed, and aesthetics of an exterior may be improved. However, it is not limited thereto, and the cabinet 100 may have the same size as the door 20.

Another aspect of the present disclosure provides a refrigerator including a cabinet including an inner case and an outer case provided to form a storage compartment, a panel fixing trim coupled to a bottom surface of the cabinet, a side panel fixed to the cabinet in such a way that one end of the side panel is hooked to the panel fixing trim and the other end of the side panel is coupled to the cabinet, the side panel provided to cover a side portion of the cabinet, and an upper panel coupled to an upper end of the side panel and provided to cover an upper portion of the cabinet. The upper panel includes a fixing protrusion extending inwardly from one side portion toward the side panel so as to be inserted into the upper end of the side panel.

The side panel may include a main body, and a cabinet coupling body bent inward from one end of the main body and connected to the cabinet, and including a fixing hole into which the fixing protrusion is inserted.

The side panel may further include a trim coupling body bent inward from the other end of the main body to form a receiving space.

The panel fixing trim may include a support flange extending downward from the cabinet and inserted into the receiving space formed in the trim coupling body of the side panel.

The refrigerator may further include a panel fixing bracket coupled to an upper surface of the cabinet and coupled to the cabinet coupling body of the side panel.

The cabinet coupling body of the side panel may include a first flange seated on the upper surface of the cabinet and including a bracket coupler coupled to the panel fixing bracket, and a second flange bent from the main body and connected to the first flange, the second flange forming a seating space in which one side portion of the upper panel is seated.

The refrigerator may further include a magnet provided between the outer case and the side panel to prevent a movement of the side panel.

While the present disclosure has been particularly described with reference to exemplary embodiments, it should be understood by those of skilled in the art that various changes in form and details may be made without departing from the spirit and scope of the present disclosure.

What is claimed is:

1. A refrigerator, comprising:
a cabinet including an outer case;
a side panel including a main body; and
an upper panel,
wherein
the side panel is configured to be detachably mounted on an outside of the outer case, an upper end of the main body being detachably mounted on an upper surface of the cabinet, so that the main body forms an exterior of one side surface of the cabinet while the side panel is mounted to the outside of the outer case, and
the upper panel is configured to be detachably coupled directly to the side panel while the side panel is mounted to the outside of the outer case so that the upper panel covers an upper portion of the cabinet.

2. The refrigerator of claim 1, further comprising:
a panel fixing trim coupled to a bottom surface of the cabinet and including:
a support flange extending toward the side panel so as to be inserted into a bottom end of the side panel to support the side panel while the side panel is mounted to the outside of the outer case.

3. The refrigerator of claim 2, wherein
the side panel includes:
a trim coupling body bent at a lower end of the main body and configured to be coupled to the panel fixing trim.

4. The refrigerator of claim 3, wherein
the trim coupling body includes:
a trim receiving member including a receiving space configured to receive the support flange of the panel fixing trim.

5. The refrigerator of claim 4, wherein
the panel fixing trim includes:
a guide protrusion protruding outward from the support flange and configured to be inserted into the trim receiving member.

6. The refrigerator of claim 2, wherein
the side panel is configured to be fixed to the cabinet by hooking a lower end of the side panel to the support flange and coupling an upper end of the side panel to the upper portion of the cabinet.

7. The refrigerator of claim 1, wherein
the side panel includes:
a cabinet coupling body bent at the upper end of the main body so as to be coupled to the upper surface of the cabinet.

8. The refrigerator of claim 7, further comprising:
a panel fixing bracket mounted on the upper surface of the cabinet and configured to be coupled to the cabinet coupling body.

9. The refrigerator of claim 8, wherein
the cabinet coupling body includes:
a first flange configured to be seated on the upper surface of the cabinet,
a bracket coupler on the first flange and configured to be coupled to the panel fixing bracket, and
a second flange bent from the main body and connected to the first flange, the second flange forming a seating space in which one side portion of the upper panel may be seated.

10. The refrigerator of claim 9, wherein
the second flange includes:
a fixing hole,
the upper panel includes:
a fixing protrusion extending inwardly from the one side portion of the upper panel, and
the fixing protrusion is configured to be inserted into the fixing hole while the one side portion of the upper panel is seated in the seating space.

11. The refrigerator of claim 1, further comprising:
a magnet disposed between the outer case and the side panel while the side panel is mounted to the outside of the outer case to prevent a movement of the side panel.

12. The refrigerator of claim 1, wherein
the side panel includes:
a first side panel to cover a first side surface of the outer case while the first side panel is mounted to the outside of the outer case, and a second side panel to cover a second side surface of the outer case while the second side panel is mounted to the outside of the outer case, and the upper panel is inserted into and fixed to an upper end of the first side panel and an upper end of the second side panel while the first side panel and the second side panel are mounted to the outside of the outer case.

* * * * *